US008109579B2

(12) United States Patent
English et al.

(10) Patent No.: US 8,109,579 B2
(45) Date of Patent: Feb. 7, 2012

(54) ADJUSTMENT APPARATUS FOR SNEEZE GUARD

(75) Inventors: Douglas A. English, El Dorado Hills, CA (US); Shawn D. Rice, Sacramento, CA (US)

(73) Assignee: Douglas A. English, El Dorado Hills, CA (US)

( * ) Notice: Subject to any disclaimer, the term of this patent is extended or adjusted under 35 U.S.C. 154(b) by 611 days.

(21) Appl. No.: 12/197,271

(22) Filed: Aug. 24, 2008

(65) Prior Publication Data

US 2010/0045149 A1 Feb. 25, 2010

(51) Int. Cl.
*A47F 9/00* (2006.01)

(52) U.S. Cl. ..... 312/137; 211/150

(58) Field of Classification Search ..... 312/140.1, 312/140.2, 140.3, 140.4, 137; 211/96, 168, 211/150, 187, 103, 190, 207; 248/274.1, 248/286.1, 241, 250

See application file for complete search history.

(56) References Cited

U.S. PATENT DOCUMENTS

| | | | | | |
|---|---|---|---|---|---|
| 3,610,562 | A * | 10/1971 | Holmes et al. | 248/286.1 |
| 3,738,606 | A * | 6/1973 | Millen | 248/449 |
| 3,921,539 | A * | 11/1975 | Berger | 108/8 |
| 4,934,643 | A * | 6/1990 | Militano, Jr. | 248/124.2 |
| 5,404,822 | A * | 4/1995 | Jaskiewicz | 108/108 |
| 5,615,854 | A * | 4/1997 | Nomura et al. | 248/287.1 |
| 5,749,480 | A * | 5/1998 | Wood | 211/169.1 |
| 6,132,018 | A | 10/2000 | McGrath | |
| 6,382,436 | B1 * | 5/2002 | Wang | 211/207 |
| 6,588,863 | B1 | 7/2003 | Yatchak et al. | |
| 7,191,908 | B2 * | 3/2007 | De Rijk | 211/191 |
| 7,472,458 | B2 * | 1/2009 | Oddsen, Jr. | 16/255 |
| 7,895,953 | B2 * | 3/2011 | Matus, Jr. | 108/27 |
| 2003/0057810 | A1 * | 3/2003 | DeWitt | 312/140 |
| 2006/0065800 | A1 * | 3/2006 | Bremmon | 248/274.1 |
| 2006/0163976 | A1 * | 7/2006 | Matus | 312/140.4 |
| 2006/0175940 | A1 * | 8/2006 | English | 312/137 |
| 2006/0192467 | A1 * | 8/2006 | Matus | 312/140.4 |
| 2007/0236112 | A1 * | 10/2007 | Williman | 312/140.4 |
| 2010/0171013 | A1 * | 7/2010 | Anderson et al. | 248/201 |

* cited by examiner

*Primary Examiner* — Darnell M Jayne
*Assistant Examiner* — Hiwot Tefera
(74) *Attorney, Agent, or Firm* — Catherine Ashley Straight

(57) ABSTRACT

An adjustment apparatus for a sneeze guard includes a support post having a mounting bar with two parallel ridges along the rear side. First and second support frames are slidably interconnected and secured to the ridges on the mounting bar in parallel relation, the outer side of first support frame facing the outer side of the second support frame. The first support plate is pivotally connected and adjustably secured in a plurality of rotational positions to the inner side of the first support frame. The first support plate includes a holder on the inner side attached to one end of a transparent pane of a sneeze guard. The second support plate is pivotally connected and adjustably secured in a plurality of rotational positions to the inner side of the second support frame. The second support plate includes a holder on the inner side attached to one end of an opposing transparent pane of a sneeze guard. The adjustment apparatus allows each of the transparent panes in a series of interconnected sneeze guard panes to be adjusted vertically and rotationally, independently of any other pane in the series.

26 Claims, 4 Drawing Sheets

ADJUSTMENT APPARATUS FOR SNEEZE GUARD

BACKGROUND OF THE INVENTION

1. Field of the Invention

The invention relates generally to an apparatus designed to adjust a transparent pane of a sneeze guard, in order to provide a barrier in front of and above displayed food and beverage items in various differing food service situations, by employing adjustment assemblies which allow the transparent pane, or each of the transparent panes in a series of interconnected sneeze guard panes, to be adjusted vertically and/or rotationally, and independently of any other pane in the series.

2. Description of the Prior Art

Various sneeze guards have been used for many years to protect, from certain contaminants, unpackaged prepared food and beverages, which are displayed in a service line for customer viewing and selection. State and local laws and regulations in fact require all such food to be shielded from droplet contamination which may be expelled from the nose or mouth of a potential customer.

Accordingly, sneeze guards are well known and widely used in the food service industry. Sneeze guards are customarily used in retail food service such as cafeterias, smorgasbords, salad bars and buffet lines, which provide a service line displaying food for a customer's selection. Sneeze guards must protect the displayed food in the zone of potential droplet contamination. The zone of potential droplet contamination is determined based upon the height and placement of the service line, and the average height range of the potential customers.

Although sneeze guards are available in several styles and configurations, typically a sneeze guard has either a rigid frame, or two or more rigid and stationary support posts, and a fixed pane of glass or plastic material which provides the shield or barrier between the displayed food and the customers. Generally, the rigid frame or support posts of the sneeze guard are permanently affixed to a stationary surface, such as a service counter.

Some sneeze guards are designed for use with an attended station in a retail food establishment or an institution. In the attended station, the customer in a service line views the displayed food from the front through a transparent shield or pane, and the selected food is served or handed to the customer by an attendant stationed behind the sneeze guard and service counter. The panes of a sneeze guard for use in an attended station service line are generally made so that such panes are completely in front of and over the displayed food or beverages, preventing the items from being handled or touched by the customers.

Sneeze guards are also used for self-service food and beverage lines. In the self-service areas, the customer in a service line also views the displayed food or beverage through a transparent pane, but then reaches under the pane to obtain the selected item. The panes of sneeze guards for use in a self-service area of a service line must be made so that such panes cover the food or beverages from the top and partially cover the displayed food from the front, allowing sufficient space for the customer to reach under the panes to obtain the selected item.

Considering all the potential variables for food service lines, including but not limited to, service counter size and height, size and placement of food containers and dispensers of food/beverage items, and height of customers, a sneeze guard which is not adjustable has severe limitations. It is clear that a non-adjustable sneeze guard must therefore be designed and constructed specifically for each application in order to ensure that the zone of potential droplet contamination is adequately covered. It is also clear that the same sneeze guard unit could not be used interchangeably for an attended station and for a self-service area service line.

Adjustable sneeze guards are also known. Such adjustable sneeze guards may have rigid support posts which may allow the transparent pane to be raised or lowered through a vertical plane. Other adjustable sneeze guards have a pivoting mechanism which allows a portion of the support post, or the shield material to pivot, thereby changing the angle of the shield material. For example, U.S. Pat. No. 6,588,863 B1, issued to Yatchak, et al., discloses such an adjustable sneeze guard.

In practical application, a sneeze guard is rarely a single shield or transparent pane supported by a rigid frame or support posts at either ends of the pane. Rather, the sneeze guard consists of an initial post connected to a first transparent pane, which is interconnected to a series of alternating intermediate posts and panes, and a terminal post or frame. There is frequently a need in the food service industry to adjust one or more of the panes: for example, to allow some portion of the sneeze guard to be used as an attended station, while other portions are used for self-service (such as selecting packaged beverage items). Further, in some circumstances the height and angle of some, but not all, of the panes may need to be adjusted to accommodate certain serving items, such as large chafing dishes. Existing sneeze guards, however, cannot accommodate this need for independent adjustments, because the adjustment mechanisms require each of the panes in the series to be adjusted in the same manner.

The present invention is directed toward addressing and solving this problem by providing an adjustment apparatus for a sneeze guard which allows each of the transparent panes in a series of interconnected sneeze guard panes to be adjusted vertically and rotationally, independently of any other pane in the series.

SUMMARY OF THE INVENTION

The adjustment apparatus for sneeze guard of the present invention includes a single pane holder assembly having a support post including a mounting bar on the upper portion of the rear side of the post, with the axes of the post and the mounting bar being in parallel relation. A support frame is slidably interconnected and secured to the rear side of the mounting bar. The outer side of a support plate is pivotally connected and secured to the inner side of the support frame, the support plate having means for adjustably securing the support plate to the support frame in a plurality of rotational positions. The support plate further includes at least one holder attached to the inner side of the plate, which holder is secured to one end of a transparent pane of a sneeze guard.

The single pane holder assembly adjustment apparatus as described immediately above is appropriate for use as the initial post of the sneeze guard; and a second single pane holder assembly, being the mirror image of the first is appropriate for use as the terminal post of the sneeze guard.

A second embodiment of the adjustment apparatus for sneeze guard of the present invention includes a double pane holder assembly attached to two (2) opposing transparent panes in a series of such panes in the sneeze guard. The double pane holder assembly includes a support post, with a mounting bar on the upper portion of the rear side of the post, with the axes of the post and the mounting bar being in parallel relation. A first support frame and a second support frame are slidably interconnected with the mounting bar in parallel relation, and each frame is secured to the rear side of the mounting bar. The outer side of the first support plate is pivotally connected and secured to the inner side of the first support frame, the support plate having means for adjustably securing the support plate to the support frame in a plurality of rotational positions. The first support plate further includes at least one holder attached to the inner side of the plate, which holder is secured to one end of a transparent pane of a sneeze guard. The outer side of the second support plate is pivotally connected and secured to the inner side of the second support frame, the support plate having means for adjustably securing the support plate to the support frame in a plurality of rotational positions. The second support plate further includes at least one holder attached to the inner side of the support plate, which holder is secured to one end of an opposing transparent pane of the sneeze guard. The adjustment apparatus allows the transparent pane to which the first support plate is attached to be adjusted both vertically and rotationally, independently of the opposing transparent pane to which the second support plate is attached.

DETAILED DESCRIPTION OF THE PREFERRED EMBODIMENT

Figures 1, 7:
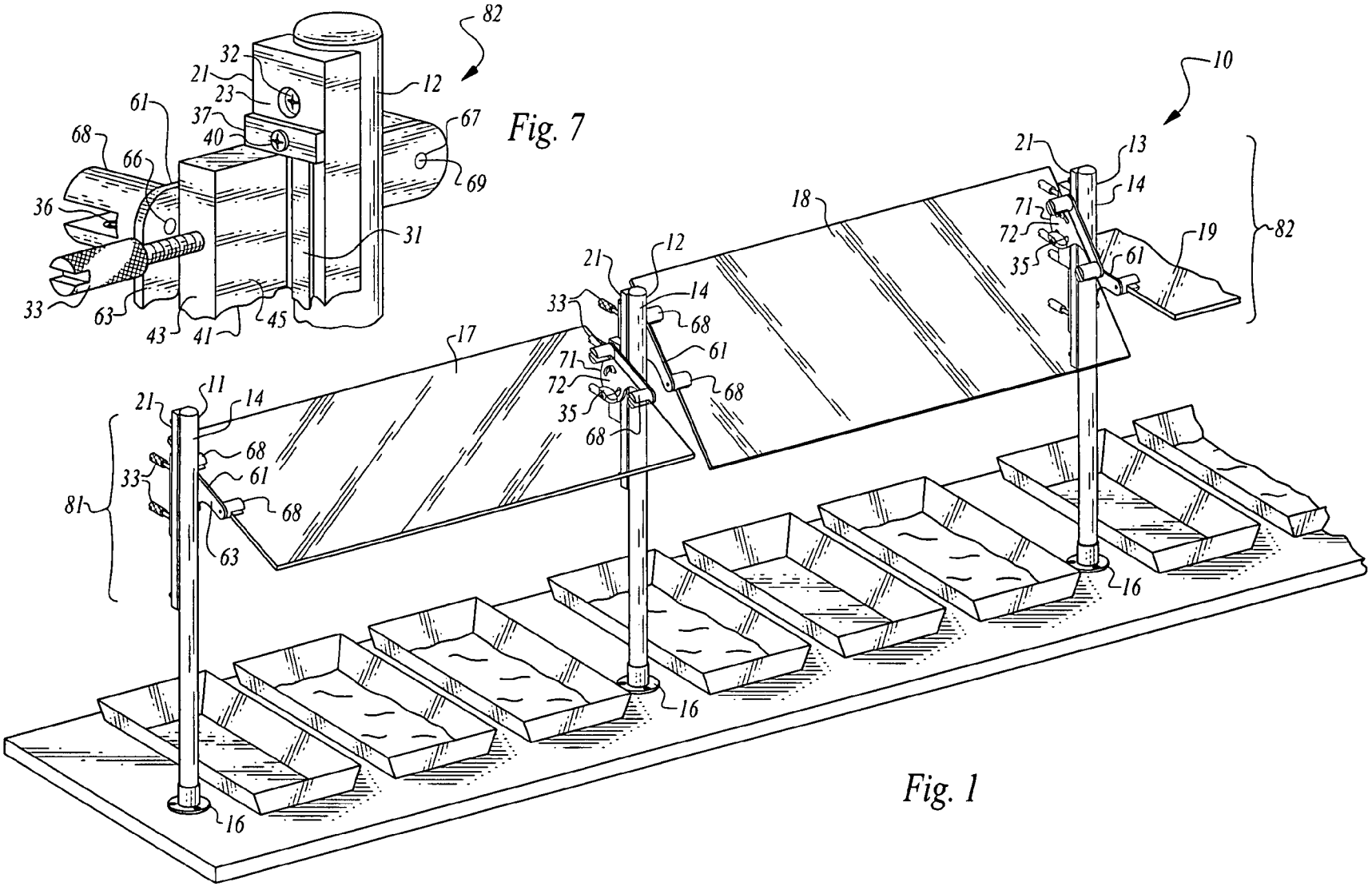
FIG. 1 is a left front perspective view of a sneeze guard, showing a plurality of transparent panes in different vertical and angular orientations, the initial support post having a single pane holder assembly adjustment apparatus, and the two intermediate posts each having a double pane holder assembly.
FIG. 7 is a close up, fragmentary, perspective view of a double pane holder assembly showing the portion of the assembly circumscribed by the arc 7-7, in FIG. 5.

Turning now to the drawings, FIG. 1 shows a sneeze guard 10, including two embodiments of the present invention. In the first embodiment, a single pane holder assembly adjustment apparatus 81 generally comprises an initial support post 11 having a mounting bar 21, a first support frame 41 (shown in FIGS. 5 and 10) and a first support plate 61 having clips 68 to hold the first end of the transparent pane 17. The second embodiment, a double pane holder assembly adjustment apparatus 82, is shown with reference to the intermediate (being the second and third in the series) support posts 12 and 13. The double pane holder assembly adjustment apparatus 82 shown generally comprises the second support post 12 having a mounting bar 21, a first support frame 41 (shown in FIGS. 5 and 10) and a first support plate 61 having clips 68 to hold the first end of the second transparent pane 18, and a second support frame 51 (see FIGS. 5 and 10) and a second support plate 71 having clips 68 to hold the opposing end of the first transparent pane 17. FIG. 1 shows a sneeze guard 10 in environment with serving trays on a service counter (shown cut away) with the front sides 14 of support posts 11, 12, and 13 facing toward the customer side and having the adjustment mechanisms of the present invention on the rear sides 15 (see FIG. 9, for example with reference to post 12) of said posts. Although the adjustment apparatuses 81 and 82 would perform satisfactorily if oriented to the front sides 14 of the posts 11, 12, 13, and 20, such is less desirable due to the increased potential for customer tampering with the adjustments.

Figure 1A:
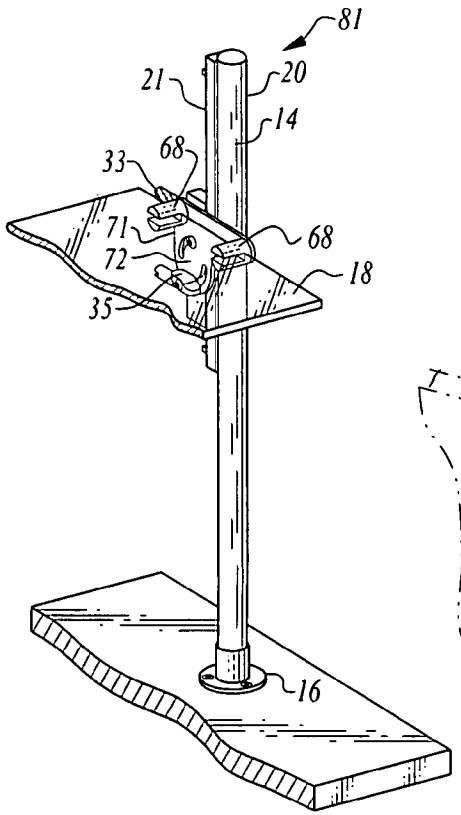
FIG. 1A is a close up detail view of an alternative single pane holder assembly showing a terminal support post with the second transparent pane as in FIG. 1 (cut away) adjusted to a more horizontal position.

In FIG. 1A, the single pane holder assembly adjustment apparatus 81 shown is a mirror image of the single pane holder assembly 81 shown in FIG. 1. The single pane holder assembly generally comprises a terminal support post 20 having a mounting bar 21, the second support frame 51 (see FIGS. 5 and 10) and second support plate 71 having clips 68 to hold the opposing end of the second transparent pane 18 (shown cut away). It will be understood that in the preferred embodiments, a single pane holder assembly 81 for either an initial support post 11, or a terminal support post 20, may be constructed from a double pane holder assembly 82 simply by removing from the assembly 82 the second support frame 51 and second support plate 71 for the initial support post 11, or by removing the first support frame 41 and a first support plate 61 for the terminal support post 20, thereby providing greater flexibility for designing and constructing adjustable sneeze guards.

In the sneeze guard 10 shown in FIG. 1, an initial support post 11, having a single pane holder assembly 81, is attached to the first transparent pane 17, the opposing end of which is attached to a second support post 12. The second support post 12 is an intermediate support post having a double pane holder assembly 82, which is further connected to the second transparent pane 18 and a third support post 13. The third support post 13 is also shown as an intermediate post having a double pane holder assembly 82, connected to the third transparent pane 19 in the series, which is shown cut away. As discussed above, the terminal support post 20 is represented in FIG. 1A. It will be appreciated that a sneeze guard may be constructed from an initial support post 11 having a single pane holder assembly 81 (as seen in FIG. 1) and a terminal support post 20 having a mirror image single pane holder assembly 81 as shown in FIG. 1A, with a single transparent pane 17 therebetween. It will further be appreciated that by adding one or more alternating intermediate support posts (such as posts 12 and 13 shown in FIG. 1) and transparent panes between the initial post 11 and first pane 17, and the terminal post 20, a sneeze guard 10 having the desired number of panes and the desired length may be constructed. The transparent panes 17, 18, and 19, shown are representative, and such panes may be shaped and/or sized differently, for example: being square rather than the rectangular shape shown; vary from that shown in either the width and/or the length; and/or have one or more curved edges. Said panes may be constructed from glass or a variety of plastic materials.

Support posts 11, 12, 13, and 20, and mounting bar 21 may be constructed of any of a variety of materials, including stainless steel, aluminum, brass, copper, other metals or alloys, and carbon fiber or graphite reinforced polymers. Support frames 41 and 51, and support plates 61 and 71, may also be constructed from any of a similar variety of materials, including stainless steel or other metals, polycarbonate or other plastics, nylon, and composites.

Figures 8, 9, 10:
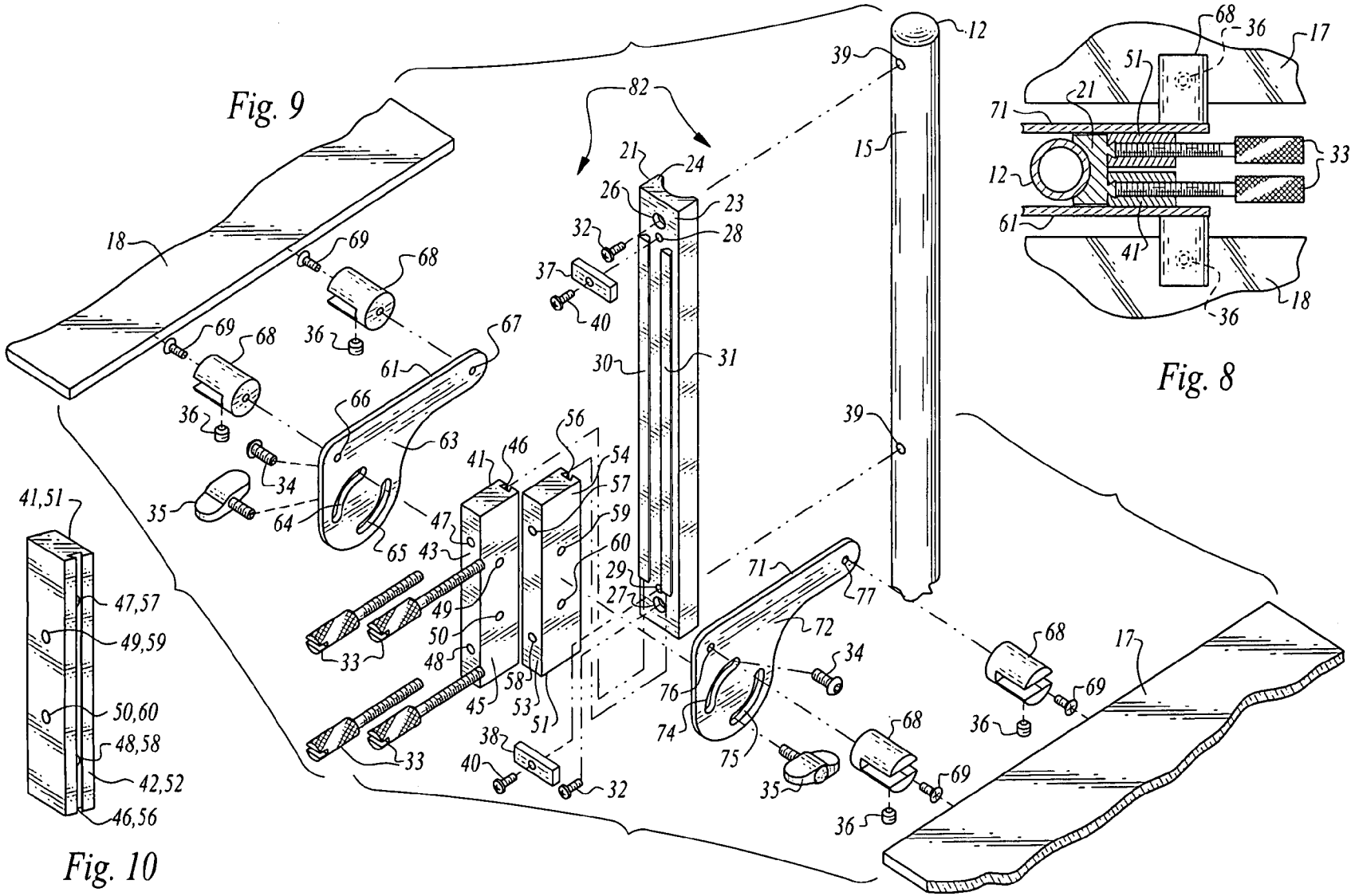
FIG. 8 is a close-up, cross-sectional view of a double pane holder assembly.
FIG. 9 is a close-up, fragmentary, exploded rear perspective view of a double pane holder assembly, with the opposing transparent panes shown cut away.
FIG. 10 is a close up, detail, front perspective view of the support frame (the first and second support frames being identical) showing the dovetail grove extending along the front side.

The initial, intermediate, and terminal support posts 11, 12, 13, and 20, each are secured to a serving counter by means of a representative base 16 (see FIG. 1). Other types of bases and/or means for securing the posts could be used in lieu of the base 16 shown, such as a clamp, bracket or platform. Other shapes and configurations of the support posts 11, 12, 13, and 20 also exist, including angled or curved posts, as well as dual post supports. In addition, other structures such as a frame could be used to support the transparent panes. Clips 68 are representative of means to attach and secure the transparent panes to the adjustment apparatus. As best shown in FIG. 9, clips 68 are secured to the inner side 62 (shown in FIGS. 4 and 4A) of support plate 61 through first and second holes 66 and 67 by clip attachment screws 69, and clips 68 are secured to the inner side 72 support plate 71 through first and second holes 76 and 77 by clip attachment screws 69. Clips 68 are further secured to transparent panes 17, 18, and 19 by inset screws 36 shown in FIGS. 5 and 9. Various other clips, clamps, brackets or frames could also be used to interconnect the transparent panes 17, 18, and 19, to the support plates 61 and 71.

Figure 4:
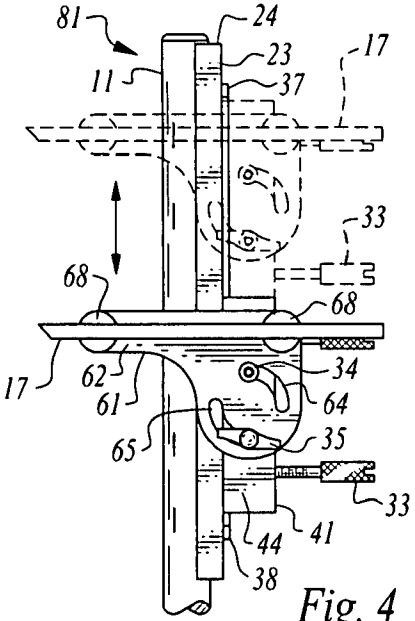
FIG. 4 is a fragmentary, side elevation view of an initial support post having a single pane holder assembly, showing the range of vertical adjustment of the assembly and transparent pane.
Figure 4A:
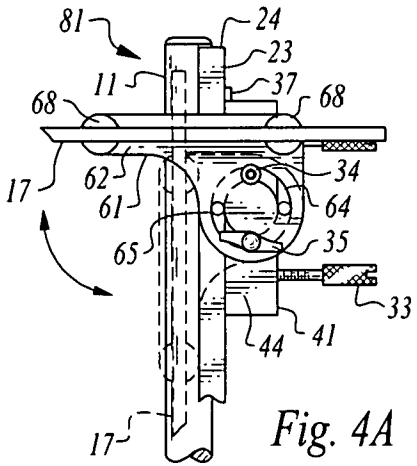
FIG. 4A is a fragmentary, side elevation view as in FIG. 4, showing the rotational adjustment of the assembly and transparent pane.

Each pane holder assembly can be adjusted both vertically (see FIG. 4), and rotationally (see FIG. 4A). The independent adjustability of each of the transparent panes 17, 18, and 19 is clearly shown in FIG. 1. Accordingly, for example: pane 17 could be lowered and angled downward to near vertical (see FIG. 4A) to prevent customer access to the food items; pane 18 could be raised and angled to a mid-way position to allow a self-service customer to reach beneath the pane; and pane 19 could be raised to a mid-height level and rotated to a horizontal position to provide a shelf (as represented in FIG. 1).

Figure 3:
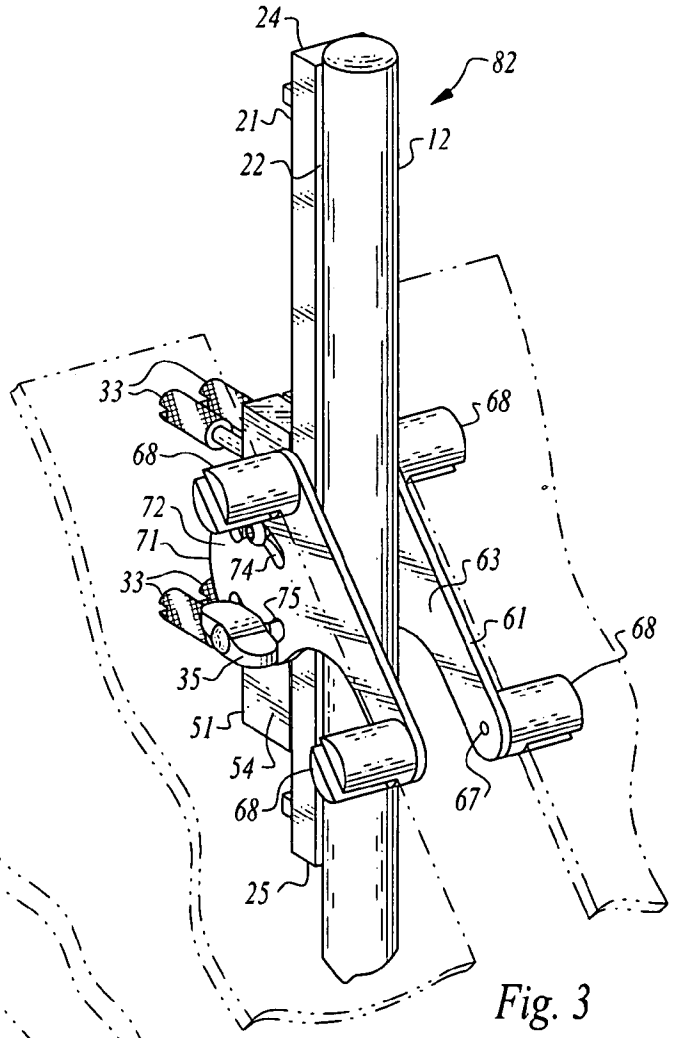
FIG. 3 is a fragmentary, front perspective view of the double pane holder assembly shown in FIG. 2.
Figure 2:
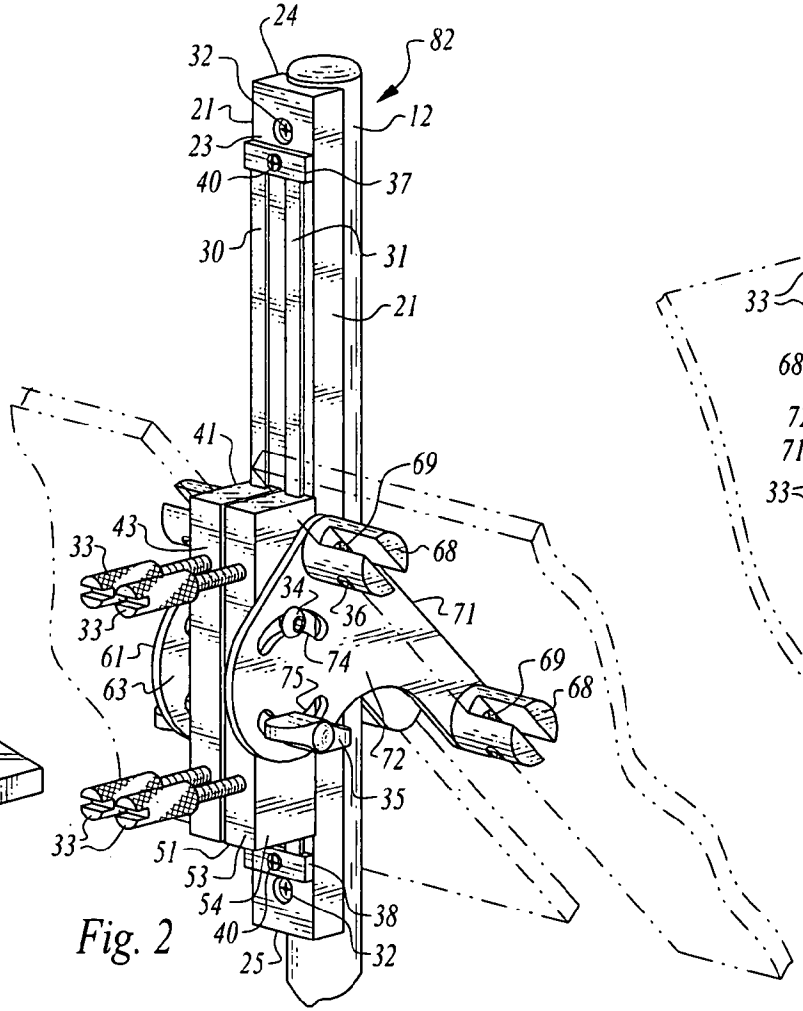
FIG. 2 is a fragmentary, rear perspective view of a double pane holder assembly adjustment apparatus, the two opposing transparent panes represented in broken line.
Figure 6:
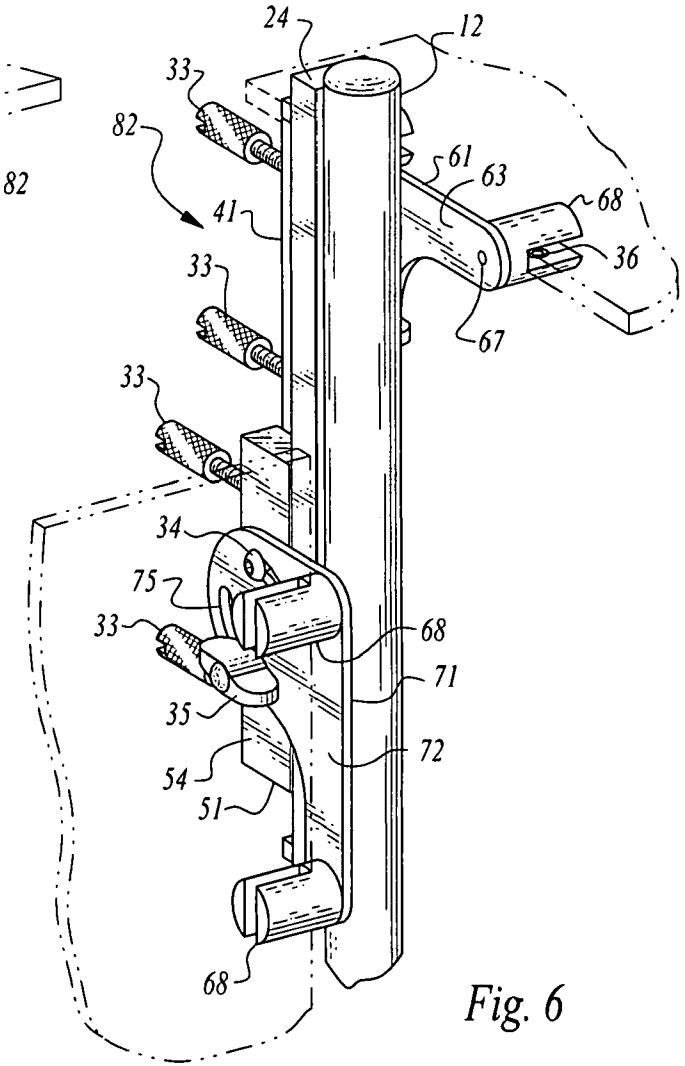
FIG. 6 is a fragmentary, front perspective view of the double pane holder assembly shown in FIG. 5.

The adjusting and securing mechanisms of the double pane holder assembly adjustment apparatus 82 are clearly shown in FIGS. 2 and 9. The front side (the edge of which is shown in FIGS. 3 and 6) of mounting bar 21 is attached to the rear side 15 of support post 12 by means of screws 32 near the proximal end 24 and near distal end 25, respectively, of mounting bar 21. Means for attachment exist such as various screws, bolts, pins, or welds, which allow the adjustment apparatus to be retrofitted to an existing support post or frame. Support posts 11, 12, 13, and 20 each could also be integrated with mounting bar 21 as a single structure, so that the rear side of the post would also be the rear side of mounting bar 21.

Figure 5:
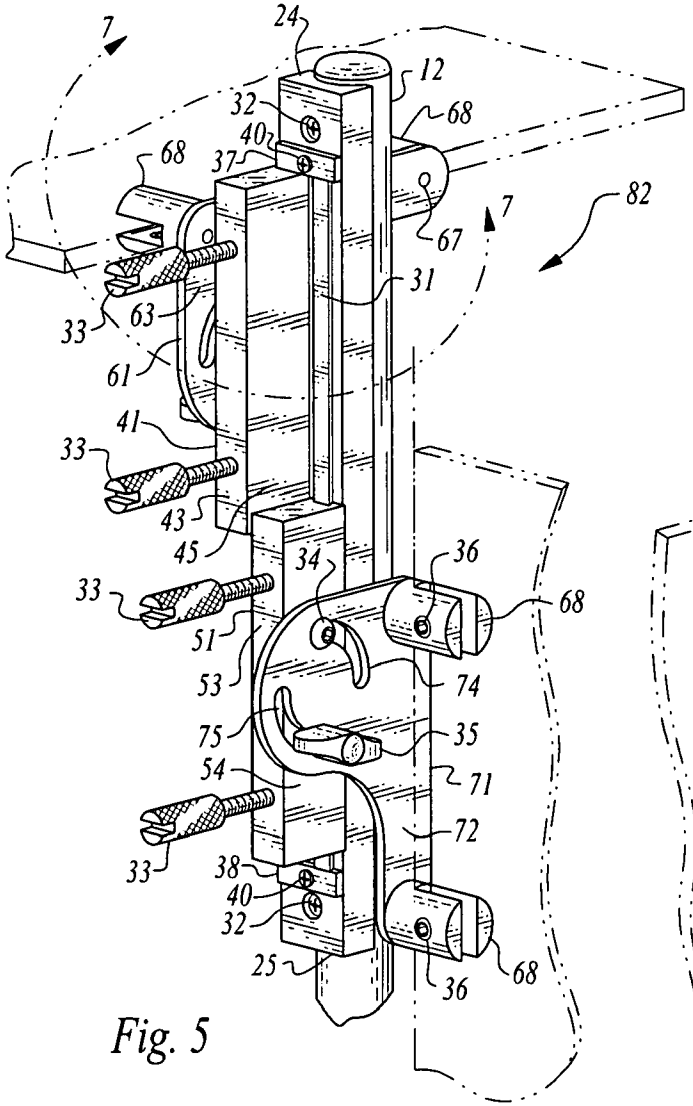
FIG. 5 is a fragmentary, rear perspective view of a double pane holder assembly, with two opposing transparent panes (shown cut away) represented in broken lines, one pane adjusted to horizontal position toward the proximal end of the mounting bar, and the other pane adjusted to a vertical position toward the distal end of the mounting bar.

As seen in FIGS. 2, 5 and 9, mounting bar 21 having a rear side 23 includes ridge 30 and ridge 31 extending along the surface of said rear side 23 from a point immediately below the proximal end stop block 37 near the proximal end 24 to a point immediately above distal end stop block 38 near the distal end 25. Ridge 30 and ridge 31 are in parallel relation to each other and to mounting bar 21.

As best shown in FIG. 9, mounting bar 21 is secured to support post 12 at the proximal end by means of a screw 32 through proximal hole 26 into screw hole 39, and at the distal end by means of a screw 32 through distal hole 27 into a second screw hole 39 in the lower portion of said support post 12. First support frame 41 and second support frame 51 are slidably interconnected to mounting bar 21 along ridges 30 and 31, respectively, with the outer side 45 of support frame 41 facing the outer side (not shown) of support frame 51. After first and second support frames 41 and 51 are slidably interconnected to mounting bar 21, proximal end stop block 37 is secured to mounting bar 21 by means of a screw 40 through said stop block 37 and into screw hole 28, and distal end stop block 38 is secured to mounting bar 21 by means of a screw 40 through said stop block 38 and into screw hole 29, thus preventing frames 41 and 51 from sliding completely off ridges 30 and 31.

A close up of support frame 41 is shown cut away in FIG. 7, adjusted toward the proximal end 24 of mounting bar 21, at proximal end stop block 37. Other structures exist which could be used in place of either of stop blocks 37 and 38, for example, either the proximal ends, or the distal ends, of ridges 30 and 31 could be flared or raised, or screws, bolts, or pins could be partially inserted either along the mounting bar or at or near the ends of ridges 30 and 31.

Preferably, each of the support posts 11, 12, 13, and 20, having a mounting bar 21 are interchangeable and may be used as a component of either the single pane holder assembly 81 or the double pane holder assembly 82.

As most clearly shown in FIG. 10, in the preferred embodiments, the first support frame 41 and second support frame 51 are structurally identical. However, in describing their respective functions as either a first or a second support frame, the sides identified as inner and outer of said frames are mirror images of the other frame. Using as an example second support frame 51, said frame is provided with a groove 56 extending along the front side 52, an upper hole 57 passing from the rear side 53 (see FIG. 9) to the front side 52, and a lower hole 58 passing from the rear side 53 to the front side 52. The groove 56 along front side 52 of support frame 51 is sized and shaped to interconnect with ridge 31 on mounting bar 21 as best seen in FIG. 9. Ridge 31 and groove 56 form a dovetail interconnection in which ridge 31 forms the dovetail and groove 56 forms the pin. It will be appreciated that such structures could be reversed with mounting bar 21 having a groove and frame 51 having a ridge. In addition, other shapes for ridges 30, 31, and grooves 46, 56, exist to interconnect mounting bar 21 and support frames 41 and/or 51, such as having one or more right angular, triangular, and/or polygonal sides.

As best seen in FIGS. 8 and 9, once first support frame 41 is slidably interconnected along first ridge 30 to mounting bar 21, the knurled head screws 33 are inserted from the rear side 43 to the front side 42 (shown in FIG. 10) through upper and lower holes 47 and 48, respectively, and secured to mounting bar 21. The second support frame 51 is slidably interconnected along second ridge 31 to mounting bar 21 and likewise secured by the knurled head screws 33 inserted from the rear side 53 to the front side 52 (see FIG. 10) through upper and lower holes 57 and 58.

A single pane holder assembly 81, used as an example in FIGS. 4 and 4A, has an initial support post 11 including the mounting bar 21 which is slidably interconnected with the first support frame 41. The first support frame 41 having an inner side 44 to which the outer side 63 (shown in FIG. 9) of first support plate 61 is pivotally connected to frame 41 by a hex head screw 34 through arcuate slot 64, and a thumb screw 35 through arcuate slot 65, the inner side 62 of plate 61 further having clips 68 to hold the first end of the transparent pane 17. Referring to FIG. 4, it can be seen that the transparent pane 17 can be adjusted vertically: by loosening the knurled head screws 33, frame 41 can be slid up or down along ridge 30 to the desired place between proximal end stop block 37 and distal end stop block 38; and then again secured by tightening the knurled head screws 33. Various other screws and/or bolts could be used to secure frames 41 and 51 to the mounting bar 21. By using the knurled head screws 33, however, the vertical adjustments may be made quickly and easily, with no or minimal tools required. Although not as desirable as the preferred embodiments because adjustability would be more limited, mounting bar 21 could also be provided with a series of holes and pins which could be used to adjust frames 41 and 51 along mounting bar 21. It will be understood that in a double pane holder assembly 82, first support frame 41 and second support frame 51 may be adjusted to different vertical positions as shown in FIGS. 5 and 6, as well as adjusted to the same vertical position as shown in FIGS. 2 and 3.

The pane holder assemblies can also be adjusted rotationally, as in the example shown in FIG. 4A. The single pane holder assembly 81 generally comprises a support post 11 including the mounting bar 21, the first support frame 41, and the first support plate 61 having clips 68 to hold the first end of the transparent pane 17 (shown cut-away). The first support plate 61 is provided with first and second opposing arcuate slots 64 and 65. As best seen in FIG. 9, support plate 61 is secured to support frame 41 by means of a hex head screw 34 passing through arcuate slot 64 into upper aperture 49 in frame 41, and a thumb screw 35 passing through arcuate slot 65 into lower aperture 50 in frame 41. The second support plate 71, most clearly seen in FIGS. 5 and 9, is pivotally connected to the inner side 54 of support frame 51 by a hex head screw 34 passing through arcuate slot 74 into upper aperture 59, and a thumb screw 35 passing through arcuate slot 75 into lower aperture 60.

When hex head screw 34 and thumb screw 35 are partially loosened, support plate 61 can rotate through an arc circumscribed by arcuate slots 64 and 65, and the attached pane 18 may be positioned at any angle from horizontal to vertical (see FIG. 4A). It will be understood that by increasing (or decreasing) the length of the arcuate slots, a greater (or lesser) degree of rotational adjustability will be achieved. In the double pane holder assembly 82, first support plate 61 and second support plate 71 may be adjusted to different rotational positions as shown in FIGS. 1, 5 and 6, as well as adjusted to the same rotational position as shown in FIGS. 2 and 3. Various other types of fasteners such as screws and/or bolts could be used to secure support plates 61 and 71 to frames 41 and 51, respectively. However, by using hex head screw 34 and thumb screw 35, the transparent pane can be secured in place while still allowing the rotational adjustments to be made quickly and easily, and with minimal tools required. Other means exist to provide the rotational adjustments, such as gear mechanisms, which are generally less desirable than the preferred embodiments because food may become lodged in such mechanisms, preventing optimum operation.

It will be appreciated that we have disclosed herein adjustment apparatus for a sneeze guard with a support post having a mounting bar with one or two support frames slidably interconnected, further having a support plate pivotally connected to the inner side of each support frame with means for adjustably securing the support plate(s) to the frame(s) in a plurality of rotational positions, which allows a transparent pane of a sneeze guard to be adjusted vertically and rotationally, independently of the other transparent panes, and further disclosed a sneeze guard having said adjustment apparatus.

What is claimed is:

1. An apparatus for adjustably supporting a sneeze guard, comprising:

a. a support post having a front side and a rear side, including a mounting bar on an upper portion of said rear side of said post, said mounting bar having a front side, a rear side, a proximal end, and a distal end, the axes of said support post and said mounting bar being in parallel relation;

b. a support frame having a front side, a rear side, an inner side, and an outer side, said support frame further having interconnection means for attaching said support frame to said rear side of said mounting bar at a selected elevation above a counter;

c. a support plate having an inner side and an outer side, said outer side being pivotally connected to said inner side of said support frame, said support plate further having means for adjustably securing said support plate to said support frame in a plurality of selected rotational positions about an axis of rotation;

d. at least one holder attached to said inner side of said support plate, said holder being secured to one end of a transparent pane of a sneeze guard, wherein said pane is adjustably supported at a selected elevation above the counter and in a selected rotational position about said axis of rotation.

2. An apparatus for adjustably supporting a sneeze guard as in claim 1 in which said interconnection means for attaching said support frame to said rear side of said mounting bar at a selected elevation above a counter comprises at least one ridge extending along the surface of said rear side of said mounting bar from said proximal end to said distal end, and at least one groove extending along said front side of said support frame, said ridge and said groove being in parallel relation, sized and configured to fit together slidably.

3. An apparatus for adjustably supporting a sneeze guard as in claim 2 in which said ridge on said mounting bar and said groove in said support frame are sized and configured to form a slidable dovetail interconnection in which said ridge forms the dovetail and said groove forms the pin.

4. An apparatus for adjustably supporting a sneeze guard as in claim 1 in which said interconnection means for attaching said support frame to said rear side of said mounting bar at a selected elevation above a counter comprises at least one groove extending along said rear side of said mounting bar from said proximal end to said distal end, and at least one ridge extending along the surface of said front side of said support frame, said groove and said ridge being in parallel relation, sized and configured to fit together slidably.

5. An apparatus for adjustably supporting a sneeze guard as in claim 4 in which said groove in said mounting bar and said ridge on said support frame are sized and configured to form a slidable dovetail interconnection in which said groove forms the pin and said ridge forms the dovetail.

6. An apparatus for adjustably supporting a sneeze guard as in claim 1 in which at least one stop is provided on said mounting bar.

7. An apparatus for adjustably supporting a sneeze guard as in claim 6 in which said stop comprises a stop block attached to said mounting bar by at least one fastener.

8. An apparatus for adjustably supporting a sneeze guard as in claim 1 in which said means for attaching said support frame to said mounting bar comprises at least one screw.

9. An apparatus for adjustably supporting a sneeze guard as in claim 1 in which said support plate further includes at least one arcuate slot.

10. An apparatus for adjustably supporting a sneeze guard as in claim 9 in which said means for adjustably securing said support plate to said support frame in a plurality of selected rotational positions about an axis of rotation comprises at least one fastener extending through said arcuate slot into said support frame.

11. An apparatus for adjustably supporting a sneeze guard as in claim 1 in which said holder is a clip.

12. An apparatus for adjustably supporting a sneeze guard, comprising:

a. a support post, having a front side and a rear side, including a mounting bar on the upper portion of said rear side of said post, said mounting bar having a front side, a rear side, a proximal end, and a distal end, the axes of said support post and said mounting bar being in parallel relation;

b. a first support frame having a front side, a rear side, an inner side, and an outer side, and a second support frame having a front side, a rear side, an inner side, and an outer side;

c. interconnection means for attaching said first support frame and said second support frame to said rear side of said mounting bar at a selected elevation above a counter; in parallel relation with said outer side of said first support frame facing said outer side of said second support frame;

d. a first support plate having an inner side and an outer side, said inner side having at least one holder attached to one end of a transparent pane of a sneeze guard, said outer side pivotally connected to said inner side of said first support frame, said first support plate further having means for adjustably securing said first support plate to said first support frame in a selected plurality of rotational positions about an axis of rotation; and e. a second support plate having an inner side and an outer side, said inner side having at least one holder attached to one end of an opposing transparent pane of a sneeze guard, said outer side pivotally connected to said inner side of said second support frame, said second support plate further having means for adjustably securing said second support plate to said second support frame in a selected plurality of rotational positions about an axis of rotation.

13. An apparatus for adjustably supporting a sneeze guard as in claim 12 in which said interconnection means for attaching said first and second support frames to said rear side of said mounting bar comprises two ridges extending along the surface of said rear side of said mounting bar in parallel relation from said proximal end to said distal end, and a groove extending along said front sides of each of said first and second support frames, said ridges and said grooves being in parallel relation, each groove sized and configured to fit together slidably with one of said ridges.

14. An apparatus for adjustably supporting a sneeze guard as in claim 13 in which at least one of said ridges on said mounting bar and at least one of said grooves are sized and configured to form a slidable dovetail interconnection in which said ridge forms the dovetail and said groove forms the pin.

15. An apparatus for adjustably supporting a sneeze guard as in claim 12 in which at least one stop is provided on said mounting bar.

16. An apparatus for adjustably supporting a sneeze guard as in claim 12 in which said interconnection means for attaching at least one of said support frames to said mounting bar comprises at least one screw.

17. An apparatus for adjustably supporting a sneeze guard as in claim 12 in which each of said first and second support plates further includes at least one arcuate slot.

18. An apparatus for adjustably supporting a sneeze guard as in claim 17 in which said means for adjustably securing said first support plate to said first support frame in a plurality of selected rotational positions about an axis of rotation comprises at least one fastener extending through said arcuate slot into said first support frame.

19. An apparatus for adjustably supporting a sneeze guard as in claim 17 in which said means for adjustably securing said second support plate to said second support frame in a plurality of selected rotational positions about an axis of rotation comprises at least one fastener extending through said arcuate slot into said second support frame.

20. An apparatus for adjustably supporting a sneeze guard as in claim 12 in which at least one of said holders is a clip.

21. An apparatus for adjustably supporting a sneeze guard, comprising:

a. a mounting bar having a front side, a rear side, a proximal end, and a distal end, further having a first and second ridge extending along the surface of said rear side of said mounting bar in parallel relation from said proximal end to said distal end;

b. a first support frame having a front side, a rear side, an inner side, and an outer side, and further having a groove extending along said front side of said first support frame, said groove being in parallel relation, and sized and configured to interconnect slidably with said first ridge on said mounting bar, said first support frame adjustably secured to said first ridge;

c. a second support frame having a front side, a rear side, an inner side, and an outer side, said outer side facing said outer side of said first support frame, said second support frame further having a groove extending along said front side of said second support frame, said groove being in parallel relation, and sized and configured interconnect together slidably with said second ridge on said mounting bar, said second support frame adjustably secured to said second ridge;

d. a first support plate including at least one arcuate slot, having an inner side and an outer side, said inner side having at least one holder attached to one end of a transparent pane of a sneeze guard, said outer side pivotally connected and adjustably secured in a plurality of selected rotational positions about an axis of rotation to said inner side of said first support frame by at least one fastener extending through said arcuate slot into said first support frame; and e. a second support plate including at least one arcuate slot, having an inner side and an outer side, said inner side having at least one holder attached to one end of an opposing transparent pane of a sneeze guard, said outer side pivotally connected and adjustably secured in a plurality of selected rotational positions about an axis of rotation to said inner side of said second support frame by at least one fastener extending through said arcuate slot into said second support frame.

22. An apparatus for adjustably supporting a sneeze guard as in claim 21 in which said mounting bar is attached to a support post or a transparent pane frame of a sneeze guard.

23. An apparatus for adjustably supporting a sneeze guard as in claim 21 in which said mounting bar is integrated with a support post or transparent pane frame of a sneeze guard.

24. An apparatus for adjustably supporting a sneeze guard as in claim 21 in which at least one stop is provided on said mounting bar.

25. An apparatus for adjustably supporting a sneeze guard as in claim 21 in which said first support plate includes two opposing arcuate slots, said outer side of said first support plate pivotally connected and adjustably secured in a plurality of selected rotational positions about an axis of rotation to said inner side of said first support frame by two fasteners, one extending through each said arcuate slot into said first support frame.

26. An apparatus for adjustably supporting a sneeze guard as in claim 25 in which at least one of said fasteners comprises a thumb screw.

* * * * *